United States Patent [19]

Bezigian et al.

[11] Patent Number: 5,023,134

[45] Date of Patent: Jun. 11, 1991

[54] POLYPROPYLENE-COATED MICROWAVEABLE WAXED PAPER

[75] Inventors: Thomas Bezigian; George T. Nebel, both of Parchment, Mich.

[73] Assignee: James River Corporation, Richmond, Va.

[21] Appl. No.: 403,866

[22] Filed: Sep. 7, 1989

[51] Int. Cl.[5] ..... B32B 33/00; B32B 29/00

[52] U.S. Cl. ..... 428/336; 428/513; 428/486; 106/901; 106/270; 106/272; 585/9

[58] Field of Search ..... 428/335, 336, 513, 486; 106/901, 270, 272; 585/9

[56] References Cited

U.S. PATENT DOCUMENTS 3,376,244 4/1968 Rundle ..... 260/28.5
3,767,444 10/1973 Zeiskerger ..... 106/272
4,235,641 11/1980 Engelmann et al. ..... 106/272
4,380,565 4/7198 Krankkala ..... 428/182
4,820,876 4/1989 Nuttens et al. ..... 585/9

OTHER PUBLICATIONS

*The Condensed Chemical Dictionary,* Von Nostrand Reinhold Company, 10th Ed., 1981, p. 837.

*Primary Examiner*—George F. Lesmes
*Assistant Examiner*—Terrel H. Morris
*Attorney, Agent, or Firm*—Finnegan, Henderson, Farabow, Garrett & Dunner

[57] ABSTRACT

A wrapping material comprising a paper-based substrate and a coating comprising a polypropylene-based wax having a molecular weight between approximately 1000 to 3000 provided on the substrate for heating and storage of articles of consumption.

36 Claims, 1 Drawing Sheet

POLYPROPYLENE-COATED MICROWAVEABLE WAXED PAPER

BACKGROUND OF THE INVENTION

1. Field of the Invention

The present invention is directed generally to polymer-coated wrapping material, and more specifically is directed to a wrapping paper having a polypropylene-based wax coating for heating and storage of articles of consumption. This invention also relates to a method of heating articles of consumption.

2. Description of Related Art

Composite wrapping materials have long been used for packaging, heating and storing articles of consumption such as food articles. Such wrapping materials not only help to preserve the freshness and cleanliness of food articles over a period of time, but also facilitate cooking, heating and heat retention of food articles by confining and retaining heated moisture or water vapors within the wrapping enclosure. Since the introduction of microwave ovens, microwave cooking and heating of foodstuffs have become widespread. Conventional wrapping materials, however, have not performed very well under microwave conditions.

Composite wrapping materials which are currently available include polyethylene coated paper, hot melt coated paper, paper with foil tissue laminations, dry waxed paper, paraffin wax coated paper, etc. These wrapping materials, however, are not well- suited for use in connection with the heating and cooking of food articles under microwave conditions. Wax papers such as paraffin wax coated paper suffer from the serious disadvantage of losing its integrity in microwave conditions since the wax melts at below 140° F. Other wrapping papers such as polyethylene coated paper suffer from the drawback of sticking together when exposed to high temperatures and thus exhibit poor release characteristics. Papers with foil tissue laminations are not suitable for use under microwave conditions since they reflect microwave energy and impede the cooking and heating of articles of food using microwaves.

Accordingly, there presently exists a need to develop a composite wrapping material which is suitable for use under microwave conditions and which overcomes the aforementioned deficiencies. Considerations of economy and efficiency in terms of both costs and manufacturing logistics must be borne in mind so as to not render the wrapping material prohibitively expensive.

SUMMARY OF THE INVENTION

The present invention overcomes the problems and disadvantages of the prior art by providing a novel polymer-coated wrapping material for use in heating and storage of articles of consumption in a safe and cost effective manner.

Accordingly, an object of the present invention is to provide a wrapping material having a polypropylene-based wax coating for use in microwave heating and storage of articles of consumption, e.g., foodstuffs.

Additional objects and advantages of the present invention will be set forth, in part, in the description which follows and, in part, will be obvious from the description or may be learned by practice of the invention. The objects and advantages of the invention may be learned by and attained by means of the instrumentalities and combination of steps particularly pointed out in the appended claims.

To achieve the foregoing objects and in accordance with the purpose of the present invention, as embodied and broadly described herein, the wrapping material of the present invention, which exhibits improved non-stick properties and physical integrity at elevated temperatures and in the presence of steam, for use in heating and packaging articles of consumption comprises a paper-based substrate and a coating comprised of polypropylene-based wax having a molecular weight between approximately 1000 to 3000 provided on the substrate.

The present invention also provides a process for heating or cooking an article of consumption comprising covering at least a portion of the surface of the article of consumption with a wrapping material comprising a paper-based substrate and a coating comprised of polypropylene-based wax having a molecular weight between approximately 1000 to 3000 provided on the substrate and subjecting the covered article of consumption to microwave energy.

Preferably, the substrate comprises a bleached kraft sheet having a weight range between approximately 10–30 lb./ream, and more preferably between approximately 18–24 lb./ream.

Additionally, the molecular weight of the polypropylene-based wax is generally between approximately 1500 and 40,000, preferably between about 1500 and 3000, and more preferably approximately 2000.

The accompanying drawings, which are incorporated in and constitute a part of this specification, illustrate embodiments of the invention and, together with the description, serve to explain the principles of the invention.

DESCRIPTION OF THE PREFERRED EMBODIMENT

Reference will now be made, in detail, to preferred embodiments of the present invention, examples of which are illustrated in the accompanying drawings and are represented generally by the numeral 10. Whenever possible, the same reference numbers will be used throughout the drawings to refer to the same or like parts.

Figure 1:
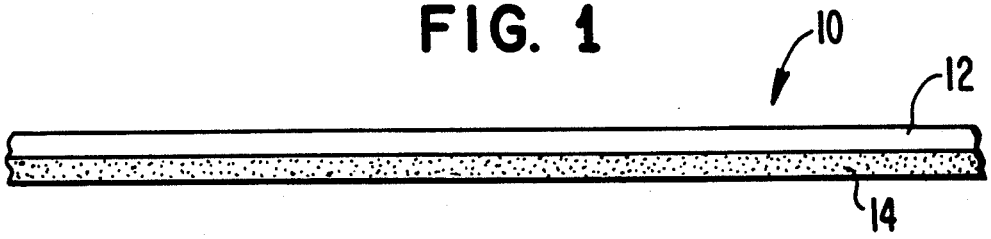
FIG. 1 is a cross-sectional view of an embodiment of the wrapping material of the present invention.
Figure 2:
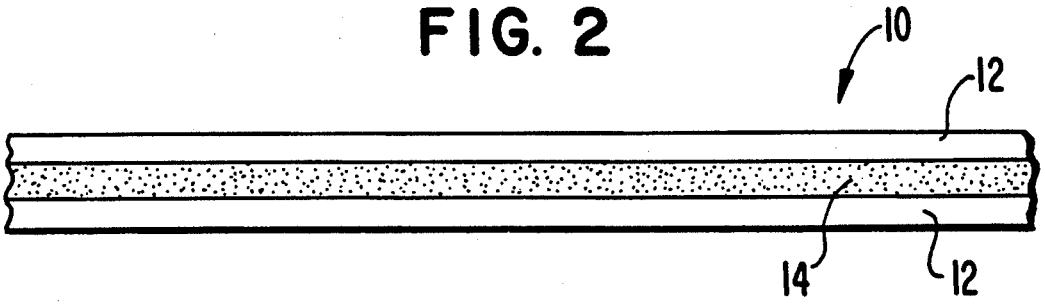
FIG. 2 is a cross-sectional view of another embodiment of the wrapping material of the present invention.

Referring to FIG. 1 and in accordance with the invention as embodied herein, there is shown generally a composite wrapping material 10 having a wax coating 12 on only one side of the substrate 14. Referring to FIG. 2 and in accordance with an alternate embodiment of the present invention, there is shown generally a composite wrapping material 10 having a wax coating 12 on both sides of the substrate 14.

The composite wrapping material 10 comprises a polymer-based wax coating 12 on a paper-based substrate 14. The wax coating 12 may be applied onto the substrate 14 using traditional waxers at a processing temperature between about 325°–500° F.

According to the invention, the substrate 14 may be traditional paper-based substrates such as bleached kraft paper sheets. The substrate 14 may also be selected from the following group of materials: non-woven synthetic polymer sheets, cloth, cellulose based sheets, etc. In the case of a paper-based substrate such as bleached kraft sheets, the weight range is between approximately 10–30 lb./ream, and more preferably between approximately 18–24 lb./ream.

In further accordance with the invention, the polymer-based wax coating 12 is a polypropylene-based wax. The molecular weight of the polypropylene wax is generally between about 1500 and 40,000, preferably between about 1500 and 3000, and more preferably about 2000. The thickness of the wax coating 12 applied on the substrate 14 is between about 0.3 mil and 1.5 mil, and more preferably about 0.5 mil.

In order to vary and adjust the properties and characteristics of the polypropylene-based wax coating, additives and modifiers may be added according to the desired result. For example, it may be desirable to vary the tackiness of the polypropylene-based wax coating in order to obtain a certain coefficient of friction on the surface of the wax coating. It may also be desirable to modify the heat sealability of the polypropylene-based wax coating in order to satisfy higher temperature heating or cooking requirements.

Reducing the coefficient of friction of the wax coating results in a wrapping material which allows easy handling of the material without clinging and sticking. To reduce the tackiness or coefficient of friction of the polypropylene-based wax coating, low molecular weight polyethylene may be blended with the wax during processing. Preferably, the weight of the polyethylene additive is between about 1,000 to 12,000. The amount of polyethylene to be added to the polypropylene is based upon the desired level of tackiness or the desired coefficient of friction of the wax coating. By increasing the amount of polyethylene which is blended with the polypropylene, tackiness or coefficient of friction exhibited by the wax coating may be decreased until the desired level of tackiness or coefficient of friction is achieved.

Similarly, slip additives such as fatty amides may be added to the polypropylene-based wax in order to decrease the coefficient of friction on the surface of the wax coating.

On the other hand, the wax layer surface may be roughened at a microscopic level by the addition of anti-block additives such as diatomaceous earth to the polypropylene-based wax. This decreases the coefficient of friction since the "roughened surface" behaves as if many microscopic ball bearings were put on the surface.

In order to improve the heat sealability of the wrapping material, ethylene vinyl acetate (EVA) may be blended with the polypropylene-based wax during processing of the polypropylene wax. The molecular weight of the ethylene vinyl acetate is preferably between about 1,000 to 12,000.

The additives and modifiers as described above may be blended with the polypropylene-based wax alone or in combination depending on the desired result to be achieved Another advantage of the present wrapping material is that no special or customized equipment is required in order to manufacture the wrapping material The molecular weight of the polypropylene-based wax is low enough to be processed in traditional waxers which have been modified to attain a 325°–500° F. processing temperature, yet, the molecular weight is high enough to resist softening or melting when subject to microwave oven conditions.

It will be apparent to those skilled in the art that various modifications and variations can be made in the wrapping material of the present invention without departing from the scope or spirit of the present invention. As noted previously, various additives and modifiers such as polyethylene, paraffin wax, antiblock and slip additives as well as toughening agents may be added to the polypropylene-based wax to modify and enhance the physical and structural properties of the resulting polypropylene-based wax coated wrapping material without departing from the scope or spirit of the present invention. Additionally, other kinds of substrates such as polymer-based substrates and cloth substrates may be used as the substrate component in the polypropylene-based wax coated wrapping material of the present invention. Thus, it is intended that the present invention cover the modifications and variations of this invention provided they come within the scope of the appended claims and their equivalents.

What is claimed is:

1. A wrapping paper for use in heating and packaging articles of consumption comprising a paper-based substrate and a coating comprised of a polypropylene wax having a molecular weight between approximately 1500 to 3000 provided on said substrate.

2. The wrapping paper as claimed in claim 1, wherein said coating is provided on one side of said substrate.

3. The wrapping paper as claimed in claim 1, wherein said coating is provided on both sides of said substrate.

4. The wrapping paper as claimed in claim 1, wherein said coating has a thickness between about 0.3 mil and 1.5 mil.

5. The wrapping paper as claimed in claim 1, wherein the molecular weight of said polypropylene wax is approximately 2000.

6. The wrapping paper as claimed in claim 1, wherein said polypropylene wax coating is provided on said substrate by coating said polypropylene wax at a temperature range between approximately 325°–500° F.

7. The wrapping paper as claimed in claim 1, wherein said paper-based substrate is a bleached kraft of 10–30 lb./ream.

8. The wrapping paper as claimed in claim 1, wherein said coating further comprises at least one additive for modifying the coefficient of friction on the surface of said coating.

9. The wrapping paper as claimed in claim 8, wherein said additive is selected from the group consisting of fatty amides, polyethylene having a molecular weight between approximately 1,000 to 12,000, and diatomaceous earth.

10. The wrapping paper as claimed in claim 8, wherein said coating is provided on one side of said substrate.

11. The wrapping paper as claimed in claim 8, wherein said coating is provided on both sides of said substrate.

12. The wrapping paper as claimed in claim 8, wherein said molecular weight of said polypropylene wax is approximately 2000.

13. The wrapping paper as claimed in claim 1, wherein said coating further comprises at least one additive for modifying the heat sealability of said coating.

14. The wrapping paper as claimed in claim 13, wherein said additive is ethylene-vinyl acetate copolymer.

15. The wrapping paper as claimed in claim 14, wherein the molecular weight of said ethylene-vinyl acetate copolymer is between about 1,000 to 12,000.

16. The wrapping paper as claimed in claim 13, wherein said coating is provided on one side of said substrate.

17. The wrapping paper as claimed in claim 13, wherein said coating is provided on both sides of said substrate.

18. The wrapping paper as claimed in claim 13, wherein said molecular weight of said polypropylene wax is approximately 2000.

19. A process for heating an article of consumption comprising:

A. covering at least a portion of the surface of the article of consumption with a wrapping material comprising a paper-based substrate and a coating comprised of a polypropylene wax having a molecular weight between approximately 1500 to 3000 provided on the substrate; and B. subjecting said covered article of consumption to microwave energy.

20. The process as claimed in claim 19, wherein said coating is provided on one side of said substrate.

21. The process as claimed in claim 19, wherein said coating is provided on both sides of said substrate.

22. The process as claimed in claim 19, wherein said coating has a thickness between about 0.3 mil and 1.5 mil.

23. The process as claimed in claim 19, wherein the molecular weight of said polypropylene wax is approximately 2000.

24. The process as claimed in claim 19, wherein said polypropylene wax coating is provided on said substrate by coating said polypropylene wax at a temperature range between approximately 325°–500° F.

25. The process as claimed in claim 19, wherein said paper-based substrate is a bleached kraft of 10–30 lb./ream.

26. The process as claimed in claim 19, wherein said coating further comprises at least one additive for modifying the coefficient of friction on the surface of said coating.

27. The process as claimed in claim 19, wherein said additive is selected from the group consisting of fatty amides, polyethylene having a molecular weight between approximately 1,000 to 12,000, and diatomaceous earth.

28. The process as claimed in claim 26, wherein said coating is provided on one side of said substrate.

29. The process as claimed in claim 26, wherein said coating is provided on both side of said substrate.

30. The process as claimed in claim 26, wherein the molecular weight of said polypropylene wax is approximately 2000.

31. The process as claimed in claim 19, wherein said coating further comprises additives for modifying the heat sealability of said coating.

32. The process as claimed in claim 31, wherein said additive is ethylene-vinyl acetate copolymer.

33. The process as claimed in claim 32, wherein the molecular weight of said ethylene-vinyl acetate copolymer is between about 1,000 to 12,000.

34. The process as claimed in claim 31, wherein said coating is provided on one side of said substrate.

35. The process as claimed in claim 31, wherein said coating is provided on both side of said substrate.

36. The process as claimed in claim 31, wherein the molecular weight of said propylene wax is approximately 2000.

* * * * *